US005828281A

United States Patent [19]

Hapke et al.

[11] Patent Number: 5,828,281

[45] Date of Patent: Oct. 27, 1998

[54] ROTARY SWITCH WITH LOW PLAY

[75] Inventors: Kenyon A. Hapke, Libertyville, Ill.; David M. Howie, Waukesha; Spencer C. Schantz, Dousman, both of Wis.

[73] Assignee: U.S. Controls Corporation, New Berlin, Wis.

[21] Appl. No.: 496,272

[22] Filed: Jun. 28, 1995

[51] Int. Cl.[6] ..... H01F 7/20

[52] U.S. Cl. ..... 335/286; 335/164

[58] Field of Search ..... 335/78–86, 286, 335/128, 124, 276, 186, 72, 164–5, 126, 140, 238

[56] References Cited

U.S. PATENT DOCUMENTS

| | | | |
|---|---|---|---|
| 3,784,944 | 1/1974 | Schantz et al. . | |
| 4,048,599 | 9/1977 | Groth | 335/155 |
| 4,264,886 | 4/1981 | Nettro | 335/163 |
| 4,338,583 | 7/1982 | Mathieu | 335/186 |
| 4,995,650 | 2/1991 | Hapke et al. . | |
| 5,153,393 | 10/1992 | Hapke et al. . | |

*Primary Examiner*—Lincoln Donovan
*Attorney, Agent, or Firm*—Quarles & Brady

[57] ABSTRACT

A rotary switch adapted to be integrated into a push-to-start electrical control for a clothes dryer or the like employs a rotatable and axially translatable operator having an outwardly extending arm supporting a downward finger which travels across a pivotally mounted and downwardly arcuate lever to open and close contacts mounted on one end of the lever with rotation of the operator. Stops on rotation ensure that the finger is positioned on the lever so as to provide positive biasing of the operator to its end positions. The armature of a relay is actuated by a second arm from the operator contacting the armature within a triangle formed by the electromagnet coil and pivot supports preventing de-stabilization of the armature by the operator. Assembly of the relay to a base of the switch is provided by integrally molded hooks receiving tabs which cover holes necessary for the hook's manufacture. The operator is supported in a socket having a thin bottom wall that breaks free upon axial impact against the operator such as otherwise would be expected to damage the integrity of the switch housing.

15 Claims, 4 Drawing Sheets

28
10
132
26
12
2A
30
18
12'
32
2A
38
38
44'
34
36
42
52
22
46
66
86
88
48
76
78
50
9
80
74
70
82
54
84
68
2B
9
14
16
24
16
20
2B
64
58

34'
102
22'
6
6
28
22
24

104
14

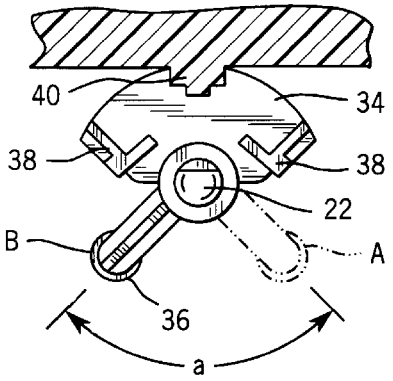
FIG. 2A
FIG. 2B
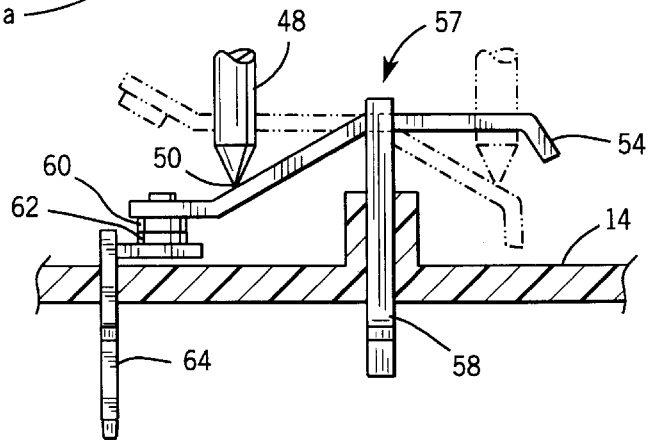
FIG. 3
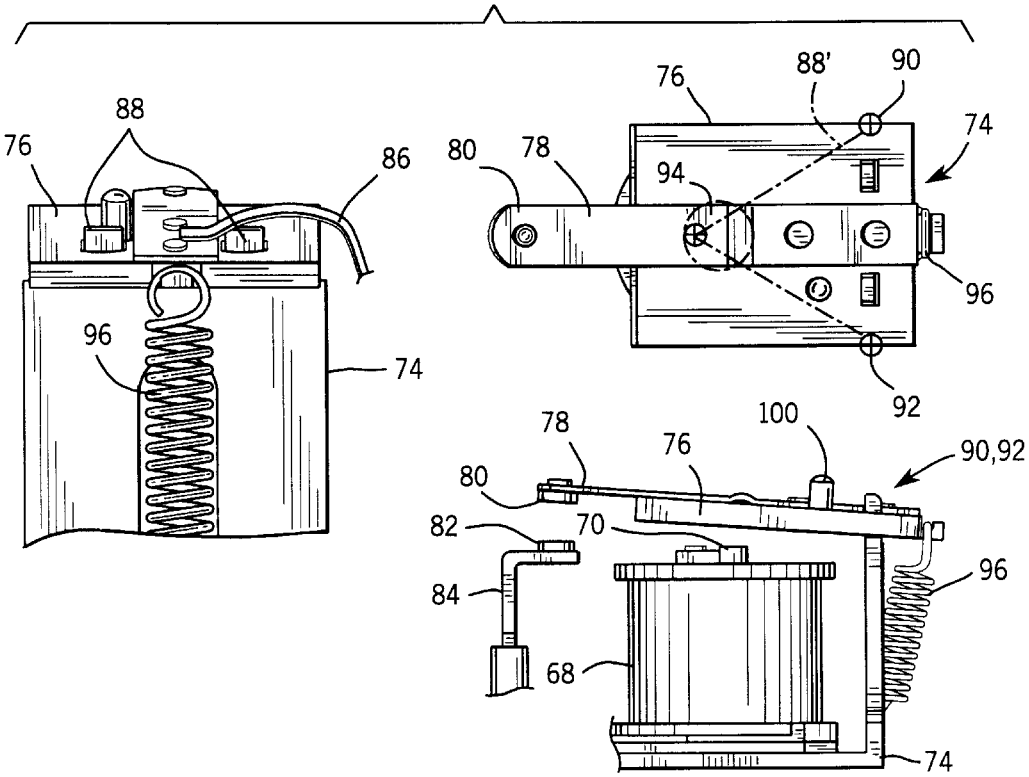

ROTARY SWITCH WITH LOW PLAY

FIELD OF THE INVENTION

The present invention concerns rotary-action electrical switches and, in particular, a design for a rotary electrical switch that may be readily combined with a push-to-start electrical switch to be used as a control for a clothes dryer or the like.

BACKGROUND OF THE INVENTION

Clothes dryers are commonly equipped with a door switch that prevents operation of the dryer when the door is open. This door switch is often connected in series with a push-to-start control. The push-to-start control has a switch which, after the door of the dryer is shut, must be operated by the user to start the dryer. An electromagnet in the push-to-start control holds the switch closed after the user has released the switch so that the dryer continues to operate until the next time the door is opened. Examples of push-to-start controls are described in U.S. Pat. Nos. 3,622,925, 3,740,682, and 4,058,781, hereby incorporated by reference.

On some dryers it is necessary to add an additional switch so that the user may control new features such as a light illuminating the dryer console or the like. This additional switch would preferably be incorporated in the push-to-start control so as to eliminate the need to mount additional components on the dryer console thus saving space and simplifying assembly of the dryer.

SUMMARY OF THE INVENTION

The present invention provides a rotary switch particularly adapted for combination with a push-to-start control such as is used on clothes dryers or the like. The rotary switch may make use of the same switch operator used by the push-to-start control. This switch operator, when pushed, closes a first set of contacts on a latching relay assembly and, when rotated, closes or opens a second independent set of contacts.

The rotary switch of the present invention has a positive switching action with low play, improved manufacturability, and features which maintain the switch's integrity under physical abuse.

More specifically, the present invention provides an electrical switch having a switch operator rotatable about an axis with respect to a switch housing, the switch operator having an arm extending outward from the axis, the arm supporting an axially extending finger. A stop limits the rotation of the switch operator to a rotation range between a first and second rotation endpoint. A lever extending along the path of the finger is contacted by the finger on its surface throughout the rotation range. The lever has a first contact affixed to one end. A second contact is positioned adjacent to the first contact to electrically connect with the first contact with movement of the lever. The surface of the lever under pressure from the finger slopes away from the outwardly extending arm at all points between a lever apex 57, which is positioned between the ends of the lever, and points on the surface of the lever at which the finger stops at the first and second rotation endpoints.

Thus, it is one object of the invention to provide a rotary switch that switches positively between two positions without play at those positions. Because the lever slopes away from the outwardly extending arm, the pressure between the lever and the finger causes the switch operator to be biased against the closest endpoint limiting play at these endpoints.

The axially extending finger may include a finger element having a rounded end fitting within a finger guide which slidably holds the finger element for movement in the axial direction. A compression spring may be positioned between the switch operator and the finger element to urge the rounded end of the finger element against the lever surface over the rotation range. The axial guide permits a predetermined transverse movement of the finger element perpendicularly to the axis so that the finger may move off the lever apex 57 without movement of the switch operator.

Thus, it is another object of the invention to provide a rotary switch with "teaseless" action. The ability of the finger element to move slightly without rotation of the switch operator prevents the finger element from being balanced at the lever apex 57 of the lever such as might produce an indeterminate actuation of the switch.

An electrical control such as may incorporate the rotary switch may include a core having a coaxial electromagnet coil. A magnetically attractable armature may be mounted proximate to the electromagnet coil to pivot about a line through a first and second pivot point inward along an axis against a coil surface when coil flows through the electromagnet coil. A spring urges the armature outward along the axis. A first contact pair communicating with the armature permits control of the electrical flow through the contact pair with movement of the armature. The switch operator positioned to the side of the armature and slidable along the axis has an arm extending over the armature to push the armature inward along the axis with a sliding of the switch operator and with the arm contacting the armature at a point within a triangle described by the vertices of the first and second pivot point and the core surface.

It is thus another object of the invention to provide a means of combining the offset operator of the rotary switch of the present invention with the armature of the switch element of the push-to start control without possibly inducing buzzing between the armature and core when the switch operator is activated by an axial push. It has been determined that if the point of contact between the switch operator and the armature is not within the described triangle, a tipping of the armature off of its pivot points may occur inducing a buzzing of the armature and possible arcing of contacts connected to the armature.

The switch may include a switch operator extending along an axis and having an arm extending outward from the axis, the arm supporting an axially extending finger. The finger may abut the surface of a lever having a first contact attached at one end. A second contact may be positioned adjacent to the first contact to electrically connect with the first contact with movement of the lever. The switch operator may in turn fit within a base having a socket providing a bore and a bottom surface, the bore supporting an inner end of the switch operator and the bottom surface being releasably attached to the bore to permit the inner end of the switch operator to pass through the base when the axial inward force on the switch operator exceeds a predetermined minimum less than that required to buckle the switch operator.

It is another object of the invention to provide a switch that may accommodate severe axial loading with lower risk of damage to the integrity of the switch housing. Placing the switch operator to the side of the contacts and armature that it activates and supporting the switch operator with a socket having a releasable bottom surface allows the switch operator to pass cleanly through the base of the switch without separating the components of the outer housing of the switch possibly exposing electrical conductors and the like.

The electrical control may include an upwardly extending switch operator and a switch element with at least one electrical terminal extending downward from a frame, the frame having at least one horizontally extending tab. The downwardly extending electrical terminal may be received within slots within a molded plastic base when the frame abuts a top of the base. The base further has at least one hole extending downward to the base, the hole covered by the tab when the frame abuts the top of the base, the hole having at one edge, an integrally molded hook for retaining the tab over the hole when the frame abuts the top of the base.

The control may further include a cover having a crushable downwardly extending stud and a hole, the cover fitting over the base with the switch operator received in the hole to enclose the switch element so that an upwardly extending boss on the switch element can crush the crushable downwardly extending stud to securely hold the frame of the switch element abutting the base.

Thus it is another object of the invention to improve the manufacturability of the aforementioned switch through the use of integrally molded retaining hooks and a crushable stud. Each hook is positioned next to a hole to permit the hook to be molded with the base by injection molding. Each hole in turn is covered by a tab on the frame so as to provide a closed enclosure. The crushable stud removes any play remaining in the attachment of the switch element to the base.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 1 is an exploded perspective view of the switch of the present invention showing alternative embodiments of a switch operator for a combined push-to-start control and rotary switch and for a push-to-start control without a rotary switch;

FIG. 2*a* is a top plan view of the first embodiment of the switch operator of FIG. 1 along line 2*a*—2*a* in FIG. 1 showing its interaction with a stop molded in a cover of the switch;

FIG. 2*b* is an elevational cross section along line 2*b*—2*b* of FIG. 1 showing the positions of a finger extending downward from the switch operator of FIG. 2*a* to a lever surface when the switch operator is at rotational endpoints of the switch operator;

FIG. 3 is end, top and side views of the coil assembly of FIG. 1 showing three points of contact of the armature to the coil frame and coil when the coil is actuated and the position of an upwardly extending boss within a triangle formed by the vertices of these three contact points;

DETAILED DESCRIPTION OF THE PREFERRED EMBODIMENT

Figures 1A, 1B, 6:
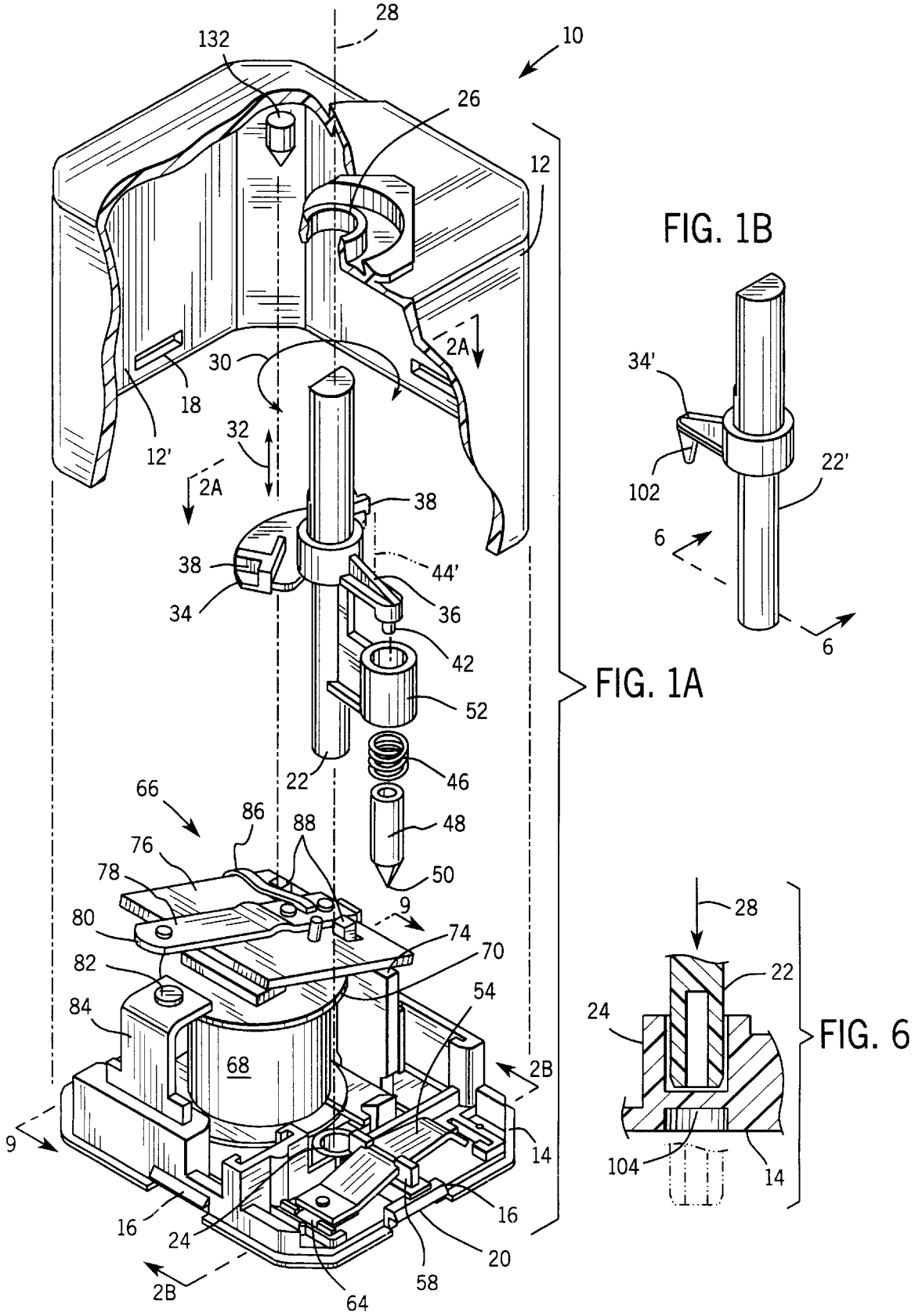
FIG. 6 is a cross-sectional view through the switch operator and base along line 6—6 of FIG. 1 showing the formation of a thin and frangible bottom surface to support the switch operator allowing the switch operator to break through that surface without disconnecting the base from the cover.

Referring to FIG. 1, an electrical control 10 according to the present invention includes a box shaped cover 12 having a bottom open face receiving a generally rectangular base 14 to provide an enclosed volume.

Extending outward from each of four edges of the base 14 along the plane of the base 14 are teeth 16 that may be received in corresponding slots 18 formed in the lower inner edges of the cover 12. The walls of cover 12 flex outward to slide past the teeth 16 until the teeth 16 reach the slots 18 and then the walls flex inward to engage the teeth 16 holding the cover 12 to the base 14.

A channel 20 is cut upward through the base 14 under the teeth 16 to permit a screwdriver or the like to be inserted within the channel to disengage the cover 12 from the teeth 16 if it is desired to remove the cover 12 from the base 14.

The base 14 and the cover 12 may be molded of thermoplastic by injection molding techniques well known in the art.

A cylindrical switch operator 22 extends vertically upward, from a socket 24 formed in the base 14, and passes through the volume enclosed by the cover 12 and the base 14 and out a hole 26 cut through an upper wall of the cover 12. Walls of the hole 26 and socket 24 support the switch operator 22 for rotation about an axis 28 indicated by arrow 30 and for sliding along the axis 28 indicated by arrow 32.

The switch operator 22 includes first and second outwardly extending arm 34 and 36 attached to the switch operator 22 approximately midway along its height. Arm 34 is substantially a sector of a circular disk co-axial with axis 28 and extending somewhat more than 90° about the switch operator 22. Arm 34 has attached to its upper surface at the radial edges of the arm 34 vertically extending walls 38.

Referring now also to FIG. 2*a*, when the cover 12 is attached to the base 14, a stop 40 extending downward from the upper wall of the cover 12 abuts the upper surface of the arm 34 between the walls 38. When the switch operator 22 is rotated about the axis 28, its range of rotation is thus limited by the stop 40 abutting one or the other of the walls 38 in either of two directions to provide rotation of the switch operator 22 indicated by angle a.

Referring still to FIGS. 1 and 2*a*, the second arm 36 during rotation moves between a first rotation endpoint A and a second rotation endpoint B. The second arm 36 (extending outward perpendicularly from axis 28) supports a pin 42 extending downwardly along a finger axis 44 parallel to axis 28. The pin 42 fits coaxially within a compression spring 46 which in turn extends downward from pin 42 into an axial bore within a generally cylindrical finger element 48. The lowermost extent of the finger element 48 tapers to a rounded point 50.

When the pin 42, spring 46, and finger element 48 are assembled together, the outer surface of the finger element 48 is supported by a finger guide 52 having a bore coaxial with the finger axis 44 and of size slightly larger than the outer diameter of the finger element 48. The finger guide 52 is also attached to the switch operator 22 to rotate therewith.

Referring still to FIGS. 1 and 2, positioned beneath the point 50 of the finger element 48 over the entire range of rotation of the switch operator 22 between endpoints A and B is an electrically conductive lever 54 pivoting about a conductive fulcrum 58, the latter extending upward from the base 14. The lever 54 is bent into a downwardly obtuse angle about a lever apex 57 which is centered over the fulcrum 58.

During rotation of the switch operator 22, the point 50 of the finger element 48 is pressed against the upper surface of the lever 54 and the lever 54 pivots about fulcrum 58 so at all times the surface of the lever 54 slopes away from the arm 36 as the switch operator 22 moves from the lever apex 57 to either of the ends of the lever 54.

One end of the lever 54 supports an electrical contact 60 on its lower surface. This contact 60 abuts a second contact 62 (attached to a terminal 64 affixed to the base 14) when arm 36 is at endpoint B with finger element 48 pressing down on the side of the lever toward the contact 60. This contact 60 moves away from contact 62 when the arm 36 is at endpoint A with the finger element 48 pushing on the side of the lever 54 opposite contact 60.

Importantly, the range of travel of the arm 36 is restricted by the previously described interaction of walls 38 and stop 40 so that finger element 48 stops on a sloping portion of lever 54. In this way, the downward pressure of finger element 48 on lever 54 in combination with the slope of lever 54 provides a rotative bias to the switch operator 22 toward whichever rotation endpoint A or B is closer. Thus when switch operator 22 is positioned so that arm 36 is at either rotative endpoint A or B, the switch operator 22 is positively held in that position without play or looseness.

Referring again to FIG. 1, the finger guide 52 provides some play to the finger element 48 so that when the finger element 48 passes over the fulcrum 58 with rotation of the switch operator 22, the change of slope of the lever 54 causes the finger element 48 to jump from one side of the lever apex 57 to the other side preventing a "teasing" of the lever action such as might be caused if finger element 48 could be accurately positioned on the lever apex 57 by careful control of the switch operator 22.

Contacts 60 and 62 provide a switching of electrical current between the terminal 64 attached to contact 62 and a terminal formed by fulcrum 58. Both terminals pass through base 14 and out of its lower surface to be accessible for wiring.

Referring still to FIG. 1, attached to the base 14 opposite the socket 24 from the lever 54 is a switch element 66 comprising generally an electromagnet coil 68 wrapped about a metallic core 70 (seen also in FIG. 5), the core 70 extending upward from the base 14. A shading ring 72, providing a substantially continuous magnetic field from electromagnet coil 68 when it is operated on alternating current, is attached to the upper end of the core 70 as is understood in the art, with the core 70 extending some what higher still to present an exposed core face.

A vertically extending metal frame 74 (also shown in FIG. 3) adjacent to electromagnet coil 68 pivotally supports a generally horizontal armature 76 at the frame's upper edge. The armature 76 is magnetically attractive and extends from the upper edge of the frame 74 over the core 70 to pivot up and down about the upper edge of the frame 74 when released or attracted by the electromagnet coil 68.

Attached to the upper surface of the armature 76 is a leaf spring 78 extending from the edge of the armature 76 abutting the frame 74 toward the core 70 and beyond the opposite edge of armature 76 to a cantilevered end which supports a contact 80 over a second contact 82 attached to a terminal 84 attached to the base 14. Thus, when the armature 76 is attracted downward to the electromagnet coil 68, contacts 80 and 82 electrically connect to provide a path of current flow between a terminal 84 attached to contact 82, through contacts 82 and 80, leaf spring 78, and flexible braid 86 connected to another terminal (not shown). Again each terminal extending downward through base 14 to be accessible for wiring.

Referring now to FIG. 3, the armature 76 is pivotally held adjacent to the upper edge of frame 74 by means of pins 88 formed in the frame 74 and extending upward from the frame 74 to fit loosely through corresponding apertures in an edge of the armature 76. The upper edge of the frame 74 is concave so that the armature 76 contacts the upper edge of the frame 74 only at two points 90 and 92 which define a pivot axis transecting both points about which the armature 76 pivots. When the electromagnet coil 68 is activated, it draws the armature 76 downward against the top of the core 70 providing a third contact point 94 for the armature 76. The contact points 90, 92 and 94 defining a stable plane of support for the armature 76 when it is drawn against the core 70. The third contact point 94 is displaced toward the edge of the face of the core 70 away from the points 90 and 92 by positioning the plane of the face of the core 70 slightly below the points 90 and 92. This increases the stability of the resulting plane of support of the armature 76.

When the electromagnet coil 68 is de-energized, the armature 76 retracts from the top of core 70 by the action of helical spring 96 attached at one end to the armature 76 but on the opposite side of the armature 76 from the electromagnet 68. The spring 96 extends downward in tension outside the "C" of the armature 76 and frame 74 and at its other end is attached to the frame 74.

Referring again to FIG. 1, the lower surface of arm 34 presses down upon the upper surface of armature 76 when the switch operator 22 is moved downward along the axial direction 28. Movement of the armature 76 connects contacts 80 and 82 which, in some modes of operation, will be wired to electromagnet 68 to draw armature 76 downward against core 70 latching contacts 80 and 82 in the closed position. It has been determined that if the point of contact between arm 34 and armature 76 lies outside of the triangle defined by points 90, 92 and 94 (shown in FIG. 3) that the armature 76 may be tipped into an unstable configuration causing a buzzing sound of the armature 76 and a possible arcing of electricity between contacts 80 and 82 such as could cause their premature failure. For this reason, a boss 100 is attached to the top surface of armature 76 within the triangle formed by points 90, 92 and 94 and extending upward therefrom to be the sole point of contact with the lower surface of the outwardly extending arm 34 with armature 76. Because the arm 34 extends an angular range about the switch operator 22 that is greater than the angle a defining the rotation range of the switch operator 22, some portion of the surface of the arm 34 is always above the boss 100 regardless of the rotation position of the switch operator 22.

Referring still to FIG. 1, conversely, if an extra switching function (as is provided by lever 54) is not required, the same components can be used for a push-to-start control of standard function by using non-rotating operator 22' having an arm 34' extending perpendicularly to axis 28 at the same height as arm 34 but having a relatively narrow angular extent commensurate with the fact that the switch operator 22 is not intended to rotate. Walls (not shown) comparable to walls 38 on arm 34 may be incorporated on arm 34' to prevent rotation of the switch operator 22.

In this embodiment, the boss 100 may be replaced by a downwardly extending tooth 102 on arm 34'. The tooth 102 is sized and placed so as to contact the upper surface of armature 76, as before, within the triangle formed by points 90, 92 and 94.

Referring now to FIG. 6, the bottom 104 of the socket 24 supporting the switch operator 22 may be molded to be substantially thinner than the base 14 so as to break free from the socket 24 at a predetermined downward force of the switch operator 22 along axis 28. Such downward force might occur, for example, during improper handling of the appliance. The thickness of the bottom 104 is selected according to the strength of the material of the base 14 so that the bottom 104 breaks free from the base 14 at a force less than that which would be required to disconnect the base 14 from the cover 12. Preventing separation between the cover 12 and base 14 reduces the possibility that live electrical conductors will be exposed to the outside environment.

Figure 4:
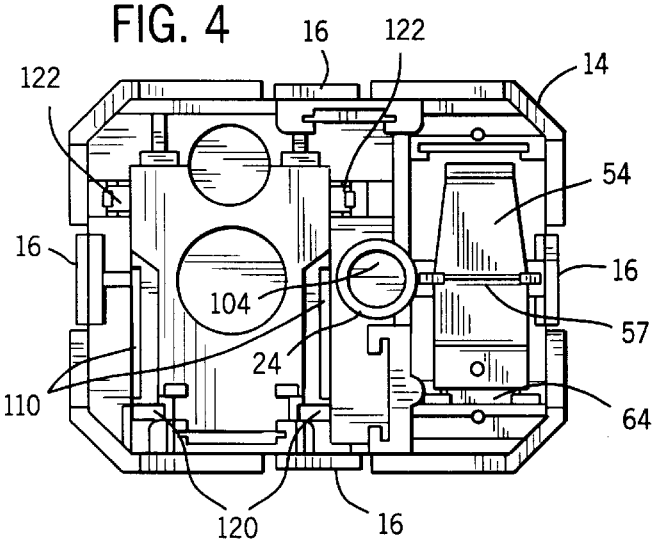
FIG. 4 is a top plan view of the base of FIG. 1 with the coil assembly and switch operator removed showing integrally molded hooks for attaching a coil bobbin to the base and extended slots for receiving the downward terminals of the coil bobbin in the base while permitting the coil bobbin to slide under molded overhangs.
Figure 5A:
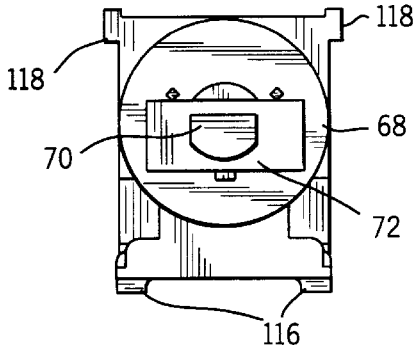
FIGS. 5*a* and 5*b* are a top plan view and perspective view respectively of the coil bobbin received in the base of FIG. 4 showing tabs for covering mold access holes adjacent to the integrally molded hooks of FIG. 4.
Figure 5B:
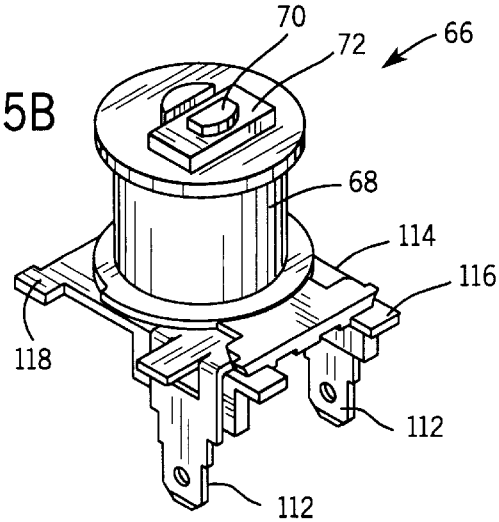

Referring to FIGS. 4, 5*a* and 5*b*, the electromagnet coil 68 of the switch element 66 is wound on a plastic bobbin 114 having a rectangular lower surface supporting downwardly extending terminals 112 attached to the wire of the electromagnet coil 68 by thin conductors. Here the frame 74 and armature 76 are not shown for clarity. Terminals 112 are of the "spade" configuration and have their planes aligned to be parallel to a transverse edge of the bobbin 114. Bobbin 114 has transversely extending planar tabs 116 at one edge and at the opposed edge has longitudinally extending tabs 118.

Figure 9:
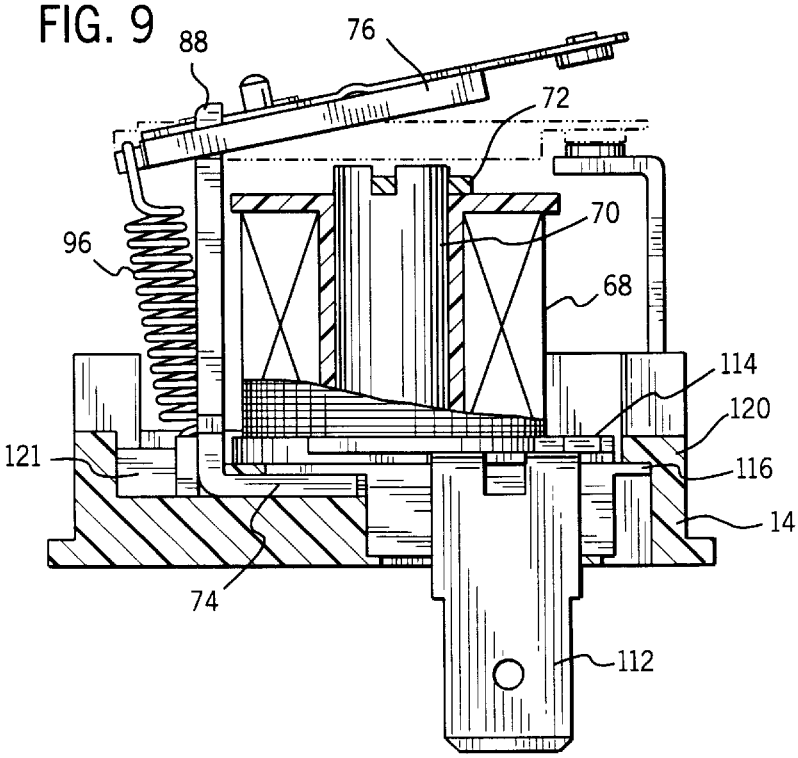
FIG. 9 is an elevational view of the assembled frame, bobbin and base taken in cross-section along line 9—9 of FIG. 4 showing the interfitting of the tabs of the bobbin to the overhang.

Referring still to FIGS. 4, 5*a*, 5*b*, and also to FIG. 9, a portion of the base 14 beneath the switch element 66 (as shown in FIG. 1) includes two transversely extending slots 110 which may receive the downwardly extending terminals 112 of the switch element 66 when it is positioned against the base 14. The slots 110 are sufficiently long so as to provide for transverse motion of the bobbin 114 permitting tabs 116 to engage beneath overhang portions 120 of the base 14 thereby preventing the end of the bobbin 114 having tabs 116 from being lifted away from the base 14. Ribs 121 abut the opposite end of the bobbin 114 from the tabs 116 preventing further transverse motion of the bobbin 144 when tabs 116 are so engaged at bobbin 114 is flat against the upper surface of the base 14.

When the bottom of the bobbin 114 of the switch element 66 is received against the top of the base 14, tabs 118 are received by locking clip 122. A lower portion of the frame 74 is thus held fast between the bobbin 114 and the base 14.

Figure 8:
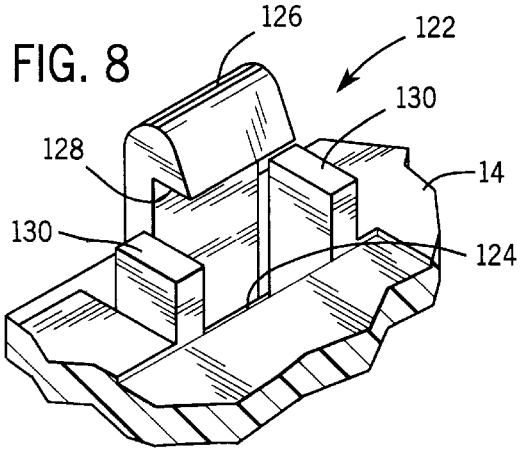
FIGS. 7 and 8 are perspective views of the integrally molded hooks of FIG. 4 showing the hooks before and after receiving the tabs of the bobbin.
Figure 7:
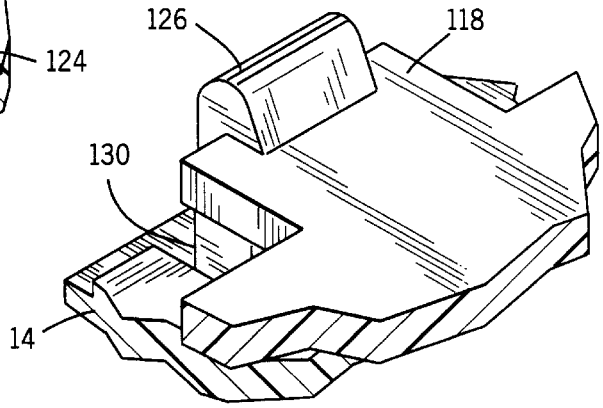

Referring now to FIGS. 7 and 8, each locking clip 122 may be integrally molded from the material of the base 14 about a rectangular mold access opening 124 through the base 14. The rectangular mold access opening 124 permits the cavity mold used for the molding of base 14 to have a projection upward through base 14 such as is necessary to form the barb 128 of a hook 126 aligned with one edge of mold access opening 124. The barb 128 extends horizontally over the mold access opening.

Flanking the mold access opening 124 on either side of the hook 126, are plateaus 130 which support the under surface of a tabs 118 when tab 118 is held by locking clip 122. Referring to FIG. 7, in order that the tabs 118 may be engaged, hook 126 flexes backward to permit tab 118 to pass the barb 128 and to rest on the upper surface of plateaus 130. In this position, tab 118 covers the mold access opening 124 preventing easy access to the interior of the electrical control 10 such as might admit wire cuttings or the like.

The combination of the hooks 126 and tab 118, and of tabs 116 and overhangs 120, prevent the bobbin 114 from disengaging from the base 14 but permit some vibration between the two with practical manufacturing tolerances. Accordingly, referring to FIG. 1, a crushable plastic stud 132 is molded into the inner surface of the upper wall of cover 12 to extend downward to abut tab 88' on the frame 74 previously described and shown in FIG. 3. Upon assembly of the cover 12 and the base 14, the stud 132 deforms only to the degree necessary to permit cover 12 to connect to base 14 thus eliminating upward or downward looseness between base 14 and the bobbin 114. Further, stud 132 prevents armature 76 from lifting off of tabs 88 under shock loading.

Figure 10:
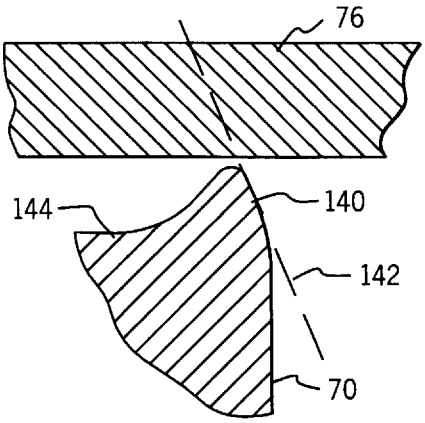
FIG. 10 is a fragmentary detailed cross-section of a core contained in the bobbin of FIG. 5*b* taken along lines 10—10 and showing a peening up of a lip on the core caused by polishing.

Referring now to FIG. 10, the armature 76 may be held away from the face 144 of the core 70, when the armature 76 is pulled downward by the electromagnet 68 (shown in FIG. 3) by a lip 140 raised about the periphery of the face 144 of the core 70 caused by a peening of the core 70 during deburring by impacting surfaces 142 (such as from other cores 70 during deburring striking the core 70 near the face 144 at angles near perpendicular with the face. The lip 140 may also be produced during plating operations, The gap so formed between the armature 76 and the face 144 decreases the force by which the armature 76 is held to the core 70.

Figure 11:
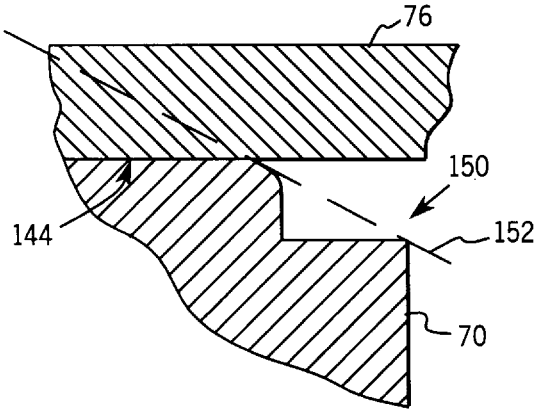
FIG. 11 is a figure similar to that of FIG. 10 showing a rim cut in the core to provide a flat core face.

Accordingly, and referring to FIG. 11, a radially extending rim 150 is formed in the periphery of the core 70 near the face 144 by cutting a channel into face 144 around its circumference. In one embodiment, the channel is approximately 0.004 inches deep (measured along the axis of the core 70 and approximately twice that distance wide (measured radially along the face 144).

The rim 150 serves to protect the edge of the face 144 from impacts by surfaces at angles nearly perpendicular to the face 144 such as might raise a ridge, allowing only impacts by surfaces 152 more nearly parallel with face 144 such as would round the edge of face 144 without raising a ridge.

The above description has been that of a preferred embodiment of the present invention. It will occur to those that practice the art that many modifications may be made without departing from the spirit and scope of the invention. For example, certain features of the invention described herein are applicable to buzzers and the like and therefore the invention should not be considered limited to relays or the like. In order to apprise the public of the various embodiments that may fall within the scope of the invention, the following claims are made.

We claim:

1. An electrical switch comprising:

(a) a switch operator rotatable about an axis with respect to a switch housing, the switch operator having an arm extending outward from the axis, the arm supporting an axially extending finger;

(b) a stop limiting the rotation of the switch operator to a rotation range between a first and second rotation endpoint;

(c) a lever extending along a path of the finger as the switch operator is rotated through the rotation range, so that a surface of the lever presses against the finger throughout the rotation range;

(d) a first contact attached to one end of the lever;

(e) a second contact positioned adjacent to the first contact to electrically connect with the first contact with movement of the lever;

wherein the surface slopes away from the outwardly extending arm under pressure of the finger so as to rotationally bias the switch operator against the rotation endpoints at positions near the rotation endpoints.

2. The electrical switch of claim 1 wherein the axially extending finger includes a finger element having a rounded end;

a finger guide slidably holding the finger element for movement in the axial direction; and a compression spring positioned between the switch operator and the finger element to urge the finger element toward the lever surface over the rotation range.

3. The electrical switch of claim 1 wherein axial guide permits a predetermined movement of the finger element perpendicular to the axis so that the finger may move off the lever apex without movement of the switch operator.

4. The electrical switch of claim 1 wherein the lever is pivotally supported at the lever apex on a fulcrum to pivot with movement of the finger on the surface of the lever over the rotation range.

5. An apparatus comprising:

(a) a core having a coaxial electromagnet coil;

(b) a magnetically attractable armature proximate to the electromagnet coil and mounted to pivot about a line through a first and second pivot point inward along an axis against a core surface when a current flows through the electromagnet coil;

(c) a spring urging the armature outward along the axis; and (d) an operator having an arm extending over the armature to push the armature inward, along the axis, the arm contacting the armature at a point within a triangle described by vertices of the first and second pivot point and the core surface.

6. The apparatus of claim 5 wherein the core is positioned with respect to the first and second pivot points so that the core surface is an area on the core maximally removed from the first and second pivot points.

7. The apparatus of claim 5 wherein the arm contacts the armature with an axially inward extending tooth on the arm.

8. The apparatus of claim 5 wherein the arm contacts the armature at an axially outward extending pin on the armature.

9. An electrical switch comprising:

a switch operator extending along an axis and having an arm extending outward from the axis, the arm supporting an axially extending finger;

(b) a lever having a surface abutting the finger;

(c) a first contact attached to one end of the lever;

(d) a second contact positioned adjacent to the first contact to electrically connect with the first contact with movement of the lever; and (e) a base and cover together enclosing a portion of the operator and the lever and the contracts when the base is attached to the cover, the base having a socket providing a bore and a bottom surface, the bore supporting an inner end of the switch operator, the bottom surface being releasably attached to the bore to permit the inner end of the switch operator to pass through the base when the axial inward force on the operator exceeds a predetermined minimum without separating the base from the cover.

10. An electrical assembly comprising:

a coil element having at least one electrical terminal extending downward from a frame, the frame having at least one transversely extending tab and one laterally extending tab; and a molded base having:

(i) transverse slots for receiving the downwardly extending electrical terminal and allowing transverse motion of the frame;

(ii) at least one hole extending downward through the base, the hole covered by the transversely extending tab when the frame is moved transversely toward the hole, the hole having at one edge an integrally molded overhang for retaining the tab over the hole (iii) at least one hole extending downward through the base, the hole covered by the longitudinally extending tab when the frame is moved to abut the top of the base, the hole having at one edge an integrally molded flexible hook for retaining the tab over the hole; and (iv) a stop, positioned together with the overhang to prevent transverse motion of the frame when the frame abuts the base.

11. The electrical assembly of claim 10 wherein the coil element includes an upwardly extending boss and further comprising:

a cover having a crushable downwardly extending stud and having a hole, the cover fitting over the base with the operator received in the hole to enclose the switch element so that the upwardly extending boss can crush the crushable downwardly extending stud to securely hold the frame of the switch element abutting the base.

12. The electrical assembly of claim 11 wherein the base and cover include elastically deformable interengaging teeth and sockets to permit the engagement of the cover and the base to hold the cover to the base.

13. An electromagnetic apparatus comprising:

a magnetically permeable core extending along an axis and having at one end a substantially planar core face;

a coil wrapped around the core;

a magnetically attractable armature pivotally mounted with respect to the core to move along the axis to abut the core face when the armature is in a closed position when electrical current passes through the coil;

wherein the core has a rim extending outward from the periphery of the core proximate to the core face but axially displaced so as not to contact the armature when the armature is in the closed position.

14. The electromagnetic apparatus of claim 13 wherein the rim extends outward from the periphery of the core by a greater distance than the rim is axially displaced from the coil face.

15. The electromagnetic control of claim 13 wherein the rim extends outward from the periphery of the core by less than 0.01 inches and the rim is axially displaced from the coil face by less than 0.01 inches.

* * * * *